US012507748B2

(12) United States Patent
Jang

(10) Patent No.: US 12,507,748 B2
(45) Date of Patent: Dec. 30, 2025

(54) ICT TECHNOLOGY-BASED COOLING CLOTHING

(71) Applicant: JANG EUN FNC CO., LTD, Seoul (KR)

(72) Inventor: Eun Jeong Jang, Seoul (KR)

(73) Assignee: JANG EUN FNC CO., LTD, Seoul (KR)

( * ) Notice: Subject to any disclaimer, the term of this patent is extended or adjusted under 35 U.S.C. 154(b) by 266 days.

(21) Appl. No.: 18/486,003

(22) Filed: Oct. 12, 2023

(65) Prior Publication Data

US 2025/0098799 A1 Mar. 27, 2025

(30) Foreign Application Priority Data

Sep. 27, 2023 (KR) ..... 10-2023-0131199

(51) Int. Cl.
*A41D 1/04* (2006.01)
*A41D 1/00* (2018.01)
(Continued)

(52) U.S. Cl.
CPC ..... *A41D 13/0053* (2013.01); *A41D 1/005* (2013.01); *A41D 1/04* (2013.01); *A41D 13/0012* (2013.01); *A41D 27/02* (2013.01)

(58) Field of Classification Search
CPC ..... A41D 1/002; A41D 1/005; A41D 1/04; A41D 13/0012; A41D 13/0025;
(Continued)

(56) References Cited

U.S. PATENT DOCUMENTS 10,674,778 B2 * 6/2020 Coza ..... A41D 31/145
11,425,944 B2 * 8/2022 Brandt ..... A41D 13/0053
(Continued)

FOREIGN PATENT DOCUMENTS

KR 10-2415705 B1 7/2022

*Primary Examiner* — Filip Zec
(74) *Attorney, Agent, or Firm* — Bridgeway IP Law Group, PLLC; Sang Ho Lee; Hyun Woo Shin

(57) ABSTRACT

An ICT technology-based piece of cooling clothing includes: an outer cover forming an external shape of the piece of cooling clothing and having a receiving pocket; a lining provided to be disposed toward the skin of a wearer that is the inside of the outer cover; a cooling pad unit disposed between the outer cover and the lining or inside the lining, made of a rectangular flexible material having short sides and long sides to transmit coolness to a wearer, and having a cooling inflow hole, cooling channels, and a cooling outflow hole; a cooling unit supplying cool air by being connected to the cooling inflow hole of the cooling pad unit and absorbing heat, which is generated by the cooling pad unit, through the cooling outflow hole, thereby performing heat dissipation and cooling; a controller provided to collect temperature information from at least any one of the cooling pad unit or the cooling unit through a temperature information collector and to transmit a cooling control signal to the cooling unit; and a user terminal connected with the controller through a network and provided to receive and display the temperature information on a display and to transmit a control signal of a user to the controller.

5 Claims, 11 Drawing Sheets

(51) Int. Cl.
*A41D 13/00* (2006.01)
*A41D 13/005* (2006.01)
*A41D 27/02* (2006.01)

(58) Field of Classification Search
CPC ..... A41D 13/0053; A41D 13/0058; A41D 27/02; F25B 21/02; F25B 2321/0212
See application file for complete search history.

(56) References Cited

U.S. PATENT DOCUMENTS

| | | | | |
|---|---|---|---|---|
| 2012/0136231 | A1* | 5/2012 | Markel | A42B 1/006 600/388 |
| 2012/0310791 | A1* | 12/2012 | Weerasinghe | H04N 21/47815 705/27.2 |
| 2016/0278444 | A1* | 9/2016 | Jordan | A41D 1/002 |
| 2019/0104776 | A1* | 4/2019 | Luoma | A41D 13/0053 |
| 2020/0046551 | A1* | 2/2020 | Garrett | A61B 5/6824 |
| 2020/0222001 | A1* | 7/2020 | Fu | A61B 5/01 |
| 2020/0335005 | A1* | 10/2020 | Green | A41D 1/04 |
| 2020/0375470 | A1* | 12/2020 | Fu | A43B 7/147 |
| 2021/0059325 | A1* | 3/2021 | Yazawa | A41D 13/0051 |
| 2021/0127769 | A1* | 5/2021 | Zombek | F25B 21/02 |
| 2021/0219632 | A1* | 7/2021 | Bogdanovich | A41D 13/0053 |
| 2022/0128276 | A1* | 4/2022 | Makansi | H10N 10/17 |
| 2022/0312858 | A1* | 10/2022 | Leach | A41D 1/002 |

* cited by examiner

ICT TECHNOLOGY-BASED COOLING CLOTHING

CROSS-REFERENCE TO RELATED APPLICATION

The present application claims priority to Korean Patent Applications No. 10-2023-0131199, filed on Sep. 27, 2023, the entire contents of which are incorporated herein for all purposes by this reference.

BACKGROUND

Technical Field

An embodiment of the present disclosure relates to an ICT technology-based piece of cooling clothing.

Description of the Related Art

Recently, devices that are combined with clothing for workers and outdoor activities in summer season to be able to adjust temperature to correspond to body temperature or an external environment are being released. However, there are few products that fundamentally satisfy convenience for activity of users, a convenient wearable feature, and convenience for washing.

In particular, a cooling function on a detailed level that wearers need is not provided, so there is a problem of deterioration of work safety, outdoor exercise effect, etc.

Therefore, there is a need for a technology of being efficient in terms of energy, securing convenience in wearing and convenience is activity, and effectively transmitting and maintaining coolness.

SUMMARY

An objective of an embodiment of the present disclosure is to provide an ICT technology-based piece of cooling clothing that can be effectively combined with various items of clothing and can effectively implement coolness through circulation of a cooling fluid.

Another objective is to provide an ICT technology-based piece of cooling clothing that can be operated directly by a wearer, can be automatically operated by sensing temperature, and can be controlled for collective cooling for group workers.

The technical subjects to implement in the present disclosure are not limited to the objectives described above and other technical subjects that are not stated herein will be clearly understood by those skilled in the art from the following specifications.

An ICT technology-based piece of cooling clothing related to an embodiment of the present disclosure for achieving the objectives described above, first, may include an outer cover (100) forming an external shape of the piece of cooling clothing and having a receiving pocket (110).

Further, the clothing may include a lining (200) provided to be disposed toward the skin of a wearer that is the inside of the outer cover (100).

In this configuration, the clothing may include a cooling pad unit (300) disposed between the outer cover (100) and the lining (200) or inside the lining (200), made of a rectangular flexible material having short sides (310) and long sides (320) to transmit coolness to a wearer, and having a cooling inflow hole (330), cooling channels (340), and a cooling outflow hole (350).

Further, the clothing may include a cooling unit (400) supplying cool air by being connected to the cooling inflow hole (330) of the cooling pad unit (300) and absorbing heat, which is generated by the cooling pad unit (300), through the cooling outflow hole (350), thereby performing heat dissipation and cooling.

Further, the clothing may include a controller (500) provided to collect temperature information from at least any one of the cooling pad unit (300) or the cooling unit (400) through a temperature information collector (510) and to transmit a cooling control signal to the cooling unit (400).

In this configuration, the clothing may include a user terminal (600) connected with the controller (500) through a network and provided to receive and display the temperature information on a display (610) and to transmit a control signal of a user to the controller (500).

In this configuration, the lining (200) is formed in a type in which first threads (210) having a first cross-section (211) and second threads (220) having a second cross-section (221), which are different cross-sections, are woven together to increase the feeling of coolness for a wearer.

In this configuration, the cooling pad unit (300) has a curved contact surface (360) disposed to have an up-down length from the center of the back to the back of the neck of a wearer and protruding to be curved toward the wearer between the long sides (320) to improve the feeling of close contact on the wearer; the controller (500) is received in the receiving pocket (110) to be able to be inserted and taken out, and the controller (500) and the cooling unit (400) are connected through a connector line (410); and the connector line (410) can be separated from the controller (500) and the cooling unit (400) and is a flexible line (411).

Meanwhile, the user terminal (600) is provided such that temperature adjustment information received from the outside through a network or temperature adjustment information input by a user is transmitted to the cooling unit (400) through the controller (500); and the cooling unit (400) is a Peltier element (420) of which a cooling level depends on the intensity of an applied current, the intensity of a current is changed by comparing the temperature information periodically collected in the controller (500) and preset temperature information with each other, a variation of the collected temperature information is calculated, and the intensity of a current is increased or decreased, depending on the degree of the variation.

Further, in the cooling pad unit (300), the cooling inflow hole (330) and the cooling outflow hole (350) are disposed on the short side (310) in a direction facing the ground in which the cooling unit (400) is positioned, the cooling channels (340) are disposed in at least one or more rows in parallel with the long sides (320) in a direction perpendicular to the ground, and the curved contact surface (360) that comes in contact with the lining (200) or the skin of a wearer is formed thinly such that a height thereof is ⅓ or ⅔ of a thickness facing the outer cover (100).

In this configuration, the curved contact surface (360) has many cooling protrusions (361) formed toward the skin of a wearer and cooling spaces (362) formed between the cooling protrusions (361) and cross-sections of the cooling protrusions (361) gradually decrease toward the skin of a wearer.

Accordingly, the present disclosure provides an ICT technology-based piece of cooling clothing, thereby, first, having an effect of effectively providing a wearer with coolness and increasing activity through circulation of a cooling fluid be being effectively combined with various items of clothing.

Further, ICT technology-based piece of cooling clothing can be operated directly by a wearer, can be automatically operated by sensing temperature, and can be controlled for collective cooling for group workers, whereby there is an effect of increasing work safety.

Meanwhile, the effects of the present disclosure are not limited to the effects described above and other effects can be clearly understood by those skilled in the art from the following description.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION

Figure 1:
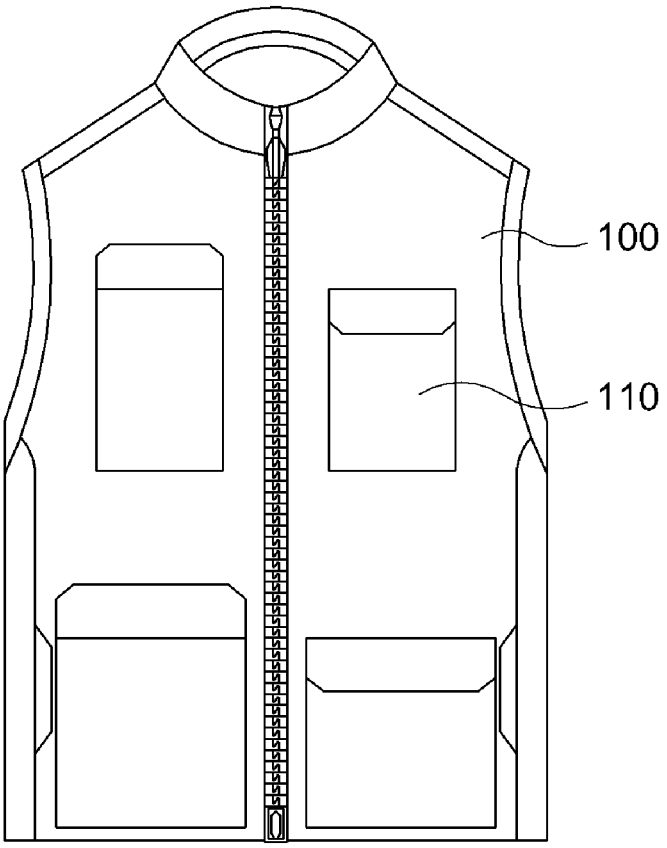
FIGS. 1 to 3 are views showing the entire configuration of an ICT technology-based piece of cooling clothing according to a preferred embodiment of the present disclosure.

Specific structural and functional description about embodiments according to the concept of the present disclosure disclosed herein is exemplified only to describe the embodiments according to the concept of the present disclosure and the embodiments according to the concept of the present disclosure may be implemented in various ways and are not limited to the embodiments described herein.

Embodiments described herein may be changed in various ways and various shapes, so specific embodiments are shown in the drawings and will be described in detail in this specification. However, it should be understood that the exemplary embodiments according to the concept of the present disclosure are not limited to the specific examples, but all of modifications, equivalents, and substitutions are included in the scope and spirit of the present disclosure.

Figure 2:
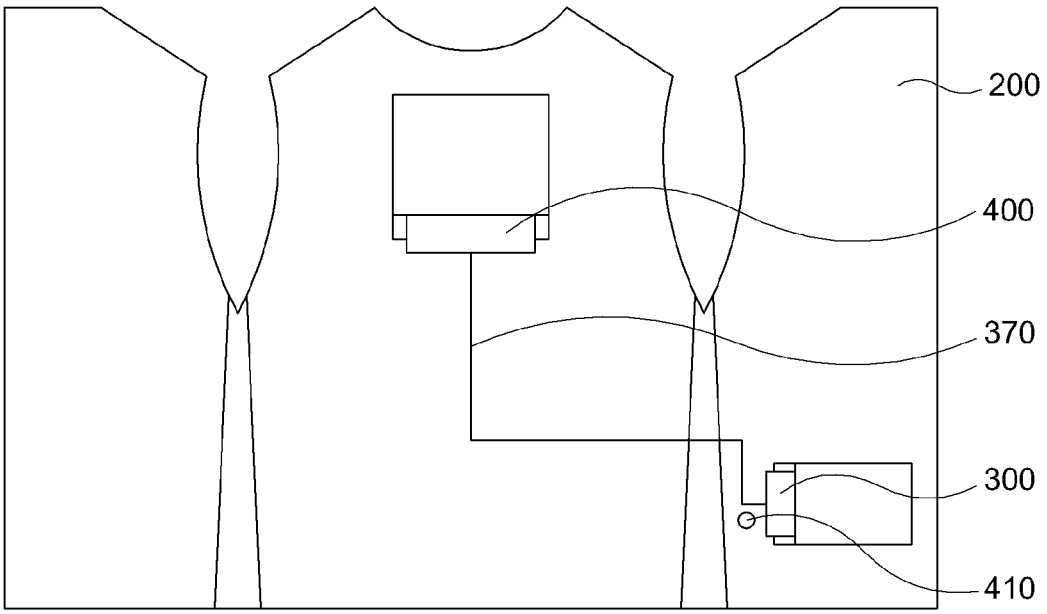
Figure 3:
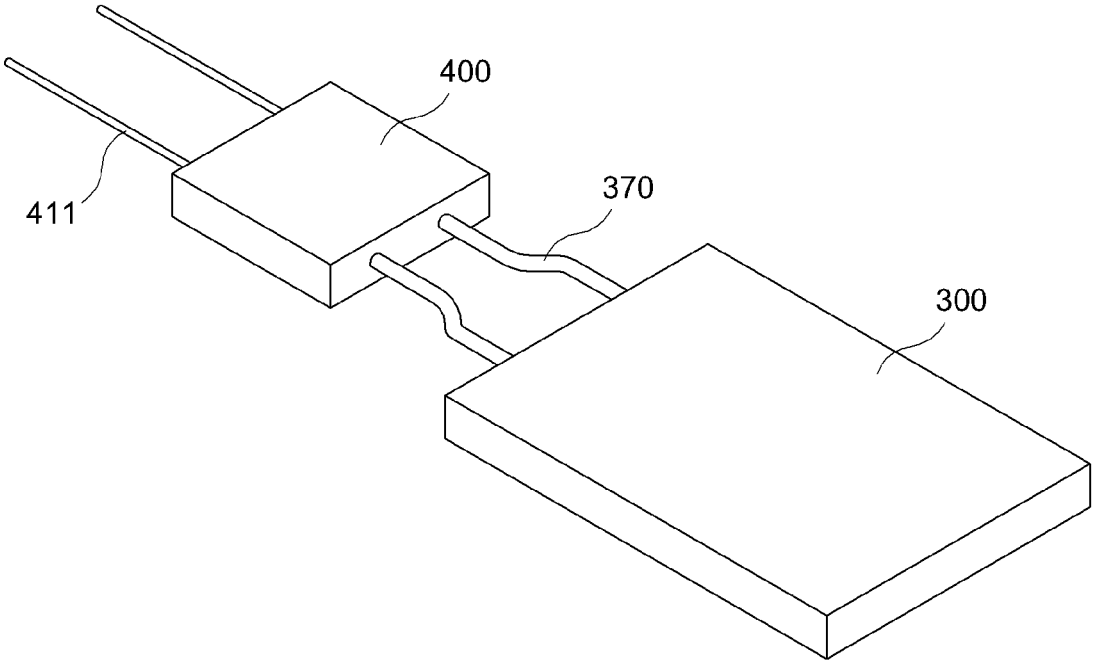
Figure 4:
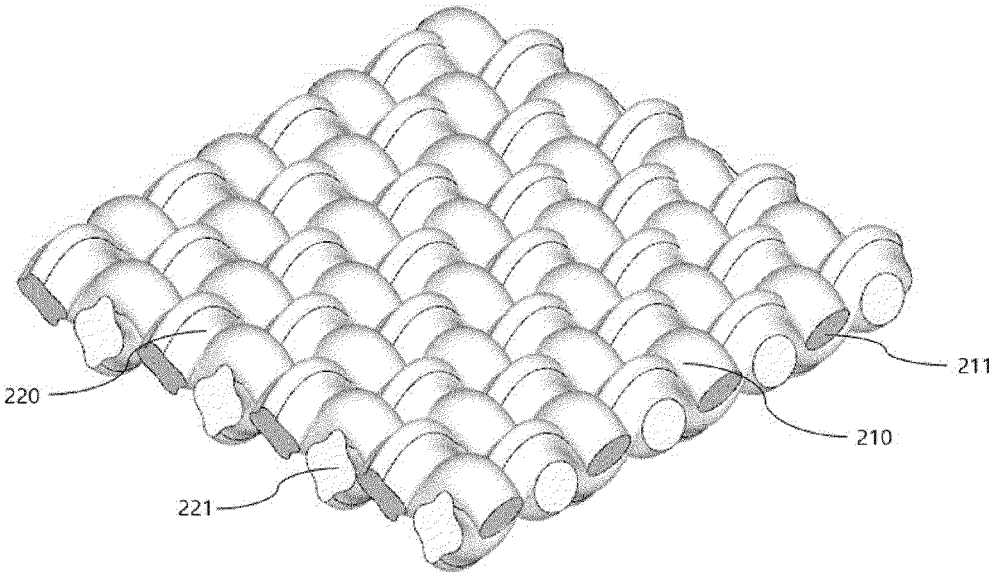
FIG. 4 is a view showing a lining of the ICT technology-based piece of cooling clothing according to a preferred embodiment of the present disclosure.
Figure 5:
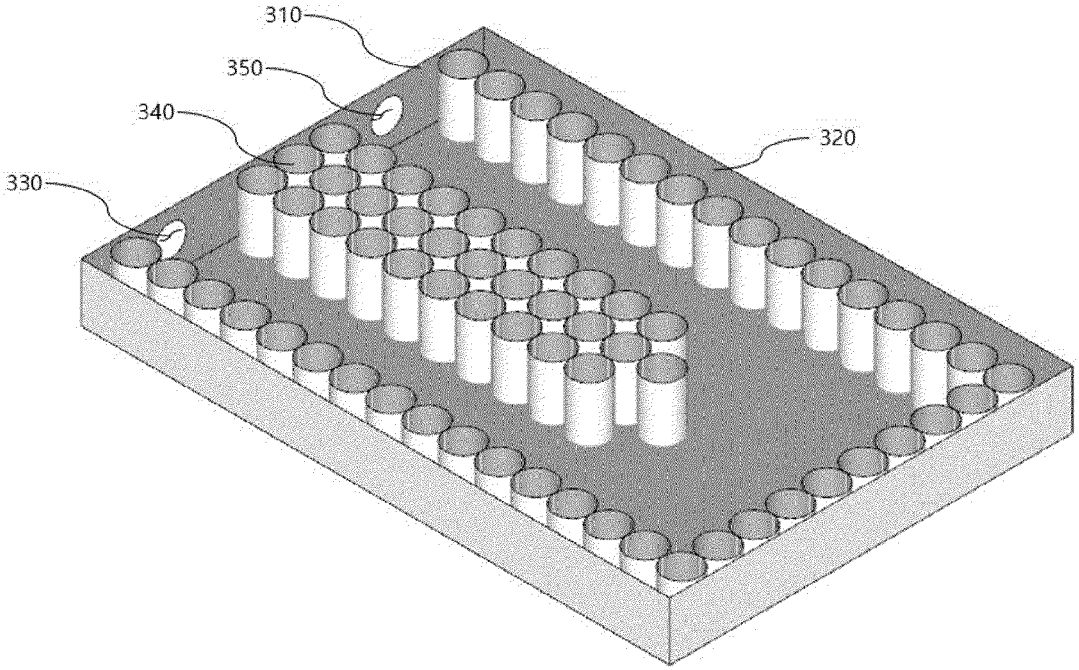
FIGS. 5 to 9 are views showing a cooling pad unit of the ICT technology-based piece of cooling clothing according to a preferred embodiment of the present disclosure.
Figure 6:
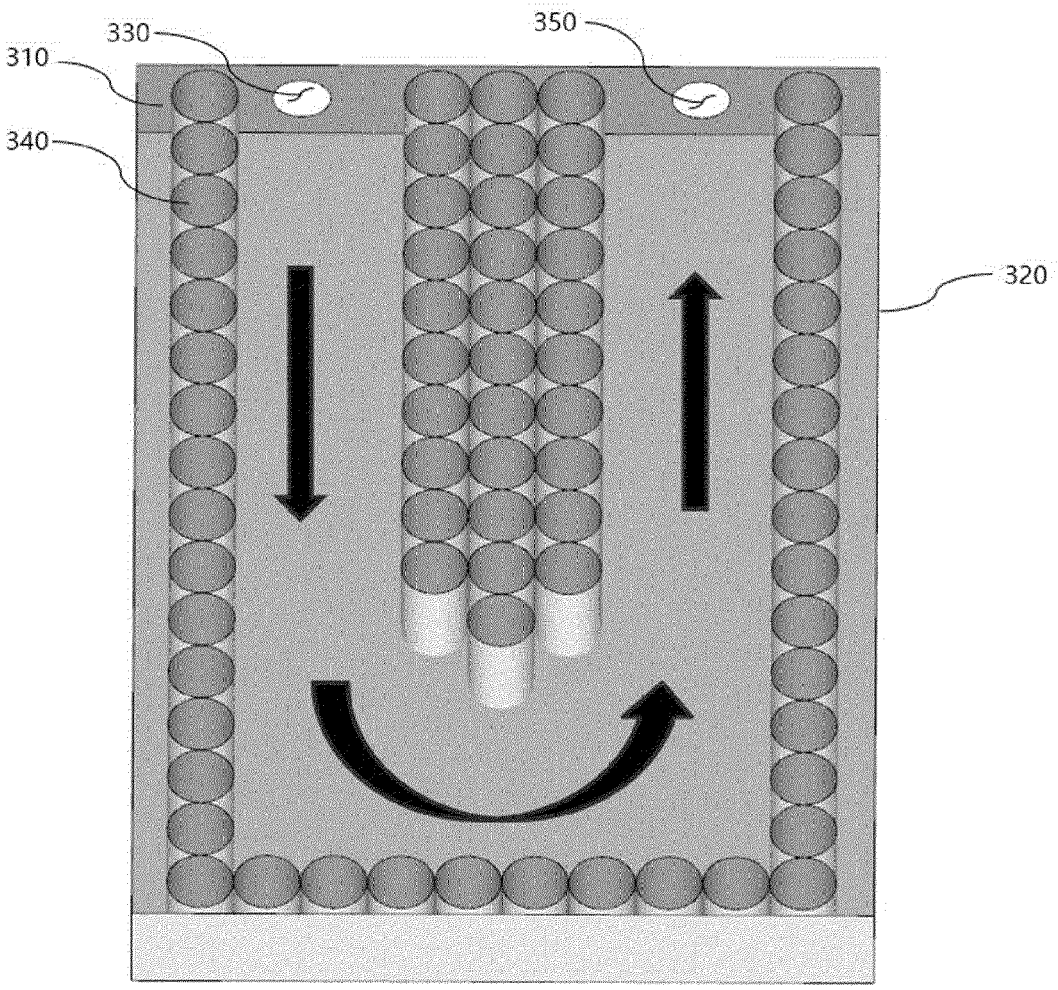
Figure 7:
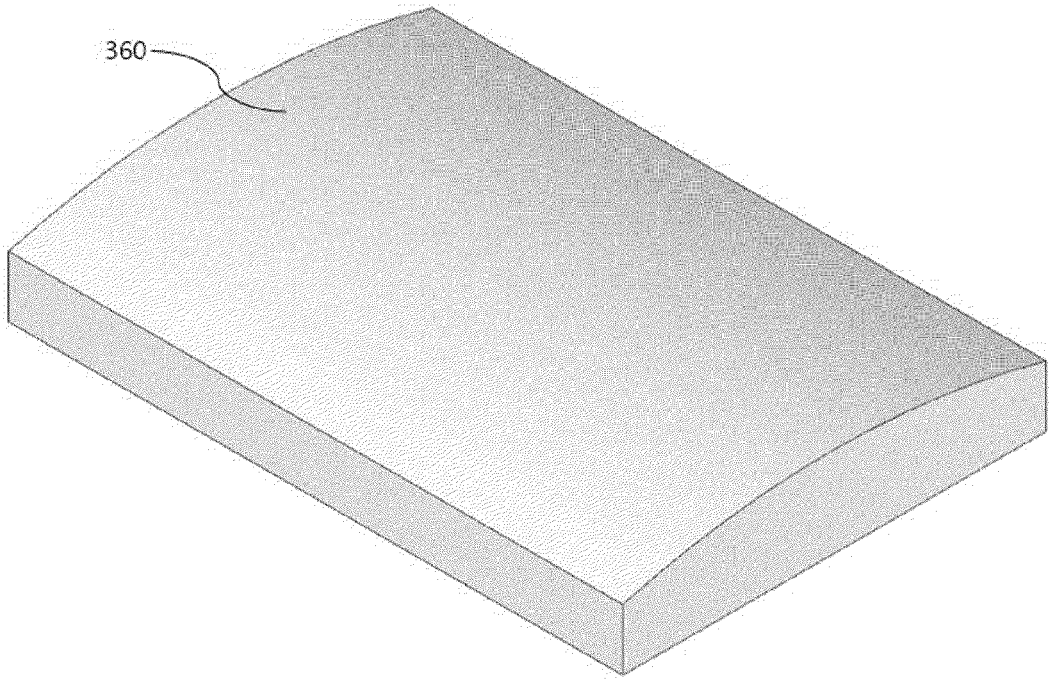
Figure 8:
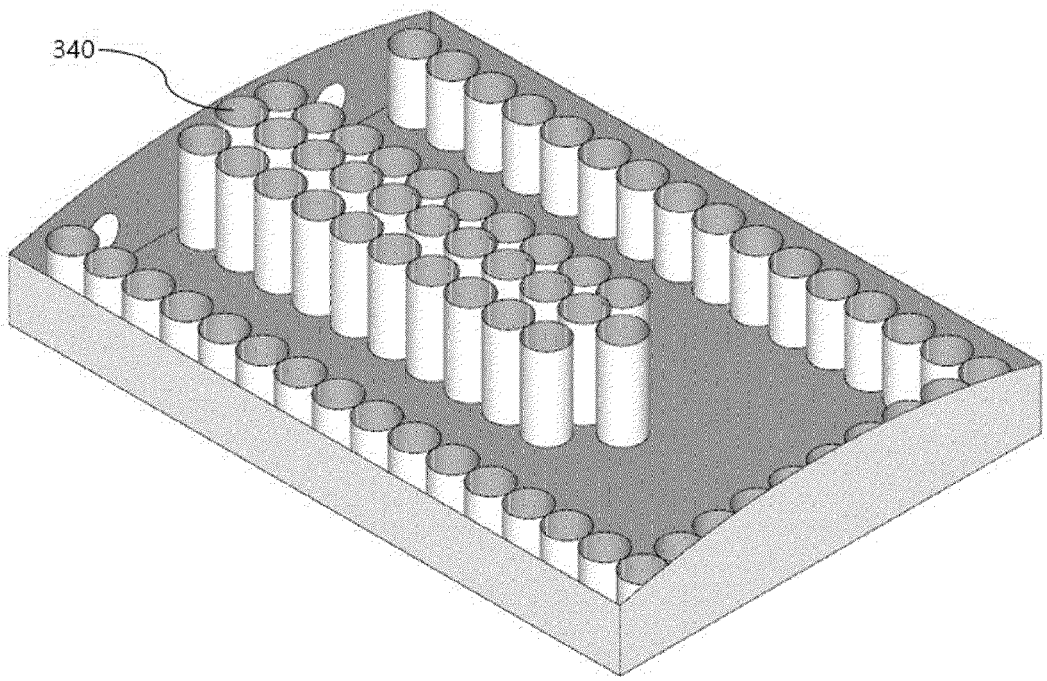
Figure 9:
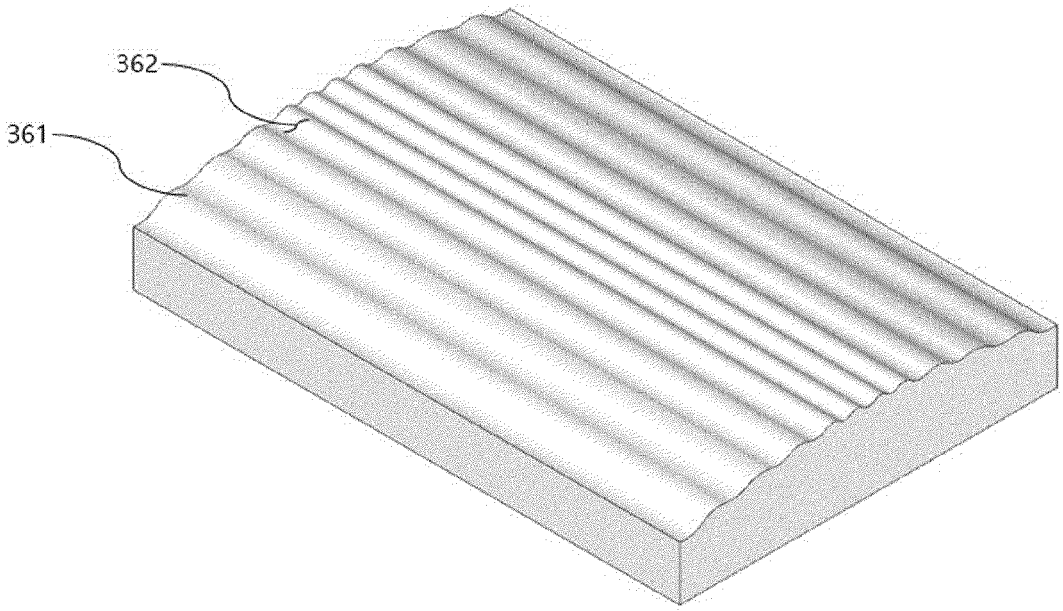
Figure 10:
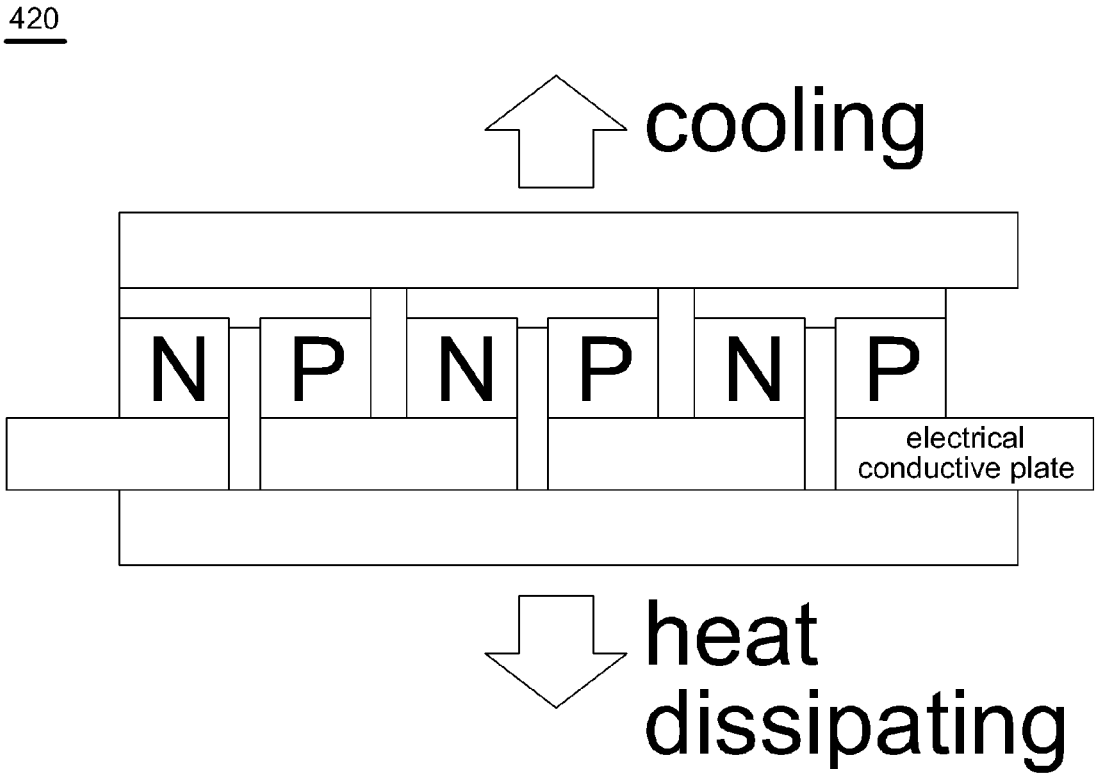
FIG. 10 is a view showing a cooling unit of the ICT technology-based piece of cooling clothing according to a preferred embodiment of the present disclosure.
Figure 11:
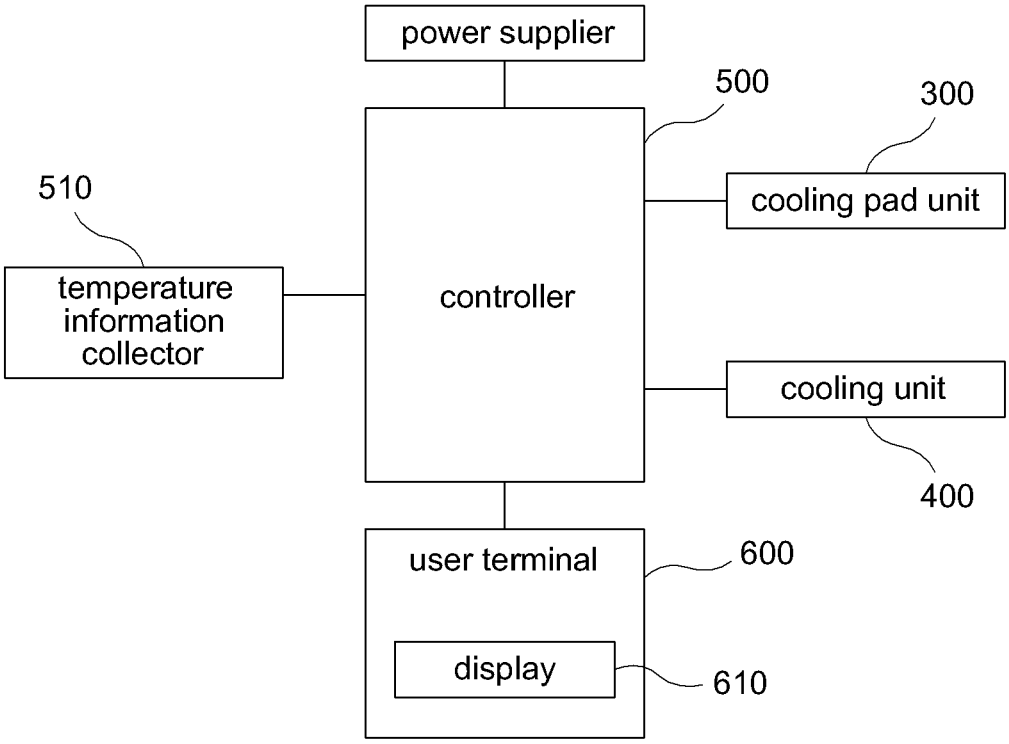
FIG. 11 is a view showing a controller of the ICT technology-based piece of cooling clothing according to a preferred embodiment of the present disclosure.

FIGS. 1 to 3 are views showing the entire configuration of an ICT technology-based piece of cooling clothing according to a preferred embodiment of the present disclosure, FIG. 4 is a view showing a lining of the ICT technology-based piece of cooling clothing according to a preferred embodiment of the present disclosure, FIGS. 5 to 9 are views showing a cooling pad unit of the ICT technology-based piece of cooling clothing according to a preferred embodiment of the present disclosure, FIG. 10 is a view showing a cooling unit of the ICT technology-based piece of cooling clothing according to a preferred embodiment of the present disclosure, and FIG. 11 is a view showing a controller of the ICT technology-based piece of cooling clothing according to a preferred embodiment of the present disclosure.

An ICT technology-based piece of cooling clothing according to an embodiment of the present disclosure, first, includes an outer cover 100 forming the external shape of the piece of cooling clothing and having a receiving pocket 110, and a lining 200 provided to be disposed toward the skin of a wearer that is the inside of the outer cover 100.

In this configuration, the clothing includes a cooling pad unit 300 that is disposed between the outer cover 100 and the lining 200 or inside the lining 200, is made of a rectangular flexible material having short sides 310 and long sides 320 to transmit coolness to a wearer, and has a cooling inflow hole 330, cooling channels 340, and a cooling outflow hole 350.

Further, the clothing includes a cooling unit 400 that supplies cool air by being connected to the cooling inflow hole 330 of the cooling pad unit 300 and absorbs heat, which is generated by the cooling pad unit 300, through the cooling outflow hole 350, thereby performing heat dissipation and cooling.

In this configuration, it is preferable that a plurality of connection tubes 370 of which an end is connected to the cooling inflow hole 330 or the cooling outflow hole 350 and the other end is connected with the cooling unit 400 is provided.

In this configuration, the clothing includes: a controller 500 provided to collect temperature information from at least any one of the cooling pad unit 300 or the cooling unit 400 through a temperature information collector 510 and to transmit a cooling control signal to the cooling unit 400; and a user terminal 600 connected with the controller 500 through a network and provided to receive and display the temperature information on a display 610 and to transmit a control signal of a user to the controller 500.

In this configuration, the user terminal 600 is configured to be able to transmit cooling control information to the controller 500 using temperature information collected to the user terminal 600 through a communication unit and is configured to transmit temperature information or activity information of a wearer that is collected through the controller 500 to an external system such that the information can always be used for sensing activity of the wearer and supporting activity of the wearer.

Meanwhile, it is preferable that the lining 200 is formed in a type in which first threads 210 having a first cross-section 211 and second threads 220 having a second cross-section 221, which are different cross-sections, are woven together to increase the feeling of coolness for a wearer.

Further, the cooling pad unit 300 has a curved contact surface 360 disposed to have an up-down length from the center of the back to the back of the neck of a wearer and protruding to be curved toward the wearer between the long sides 320 to improve the feeling of close contact on the wearer, and the controller 500 is received in the receiving pocket 110 to be able to be inserted and taken out. The controller 500 and the cooling unit 400 are connected through a connector line 410 and the connector line 410 can be separated from the controller 500 and the cooling unit 400 and is a flexible line 411.

In this configuration, it is preferable that the height of the cooling channels 340 gradually increases toward the center of the cooling pad unit 300 so that the curved contact surface 360 can be easily formed.

Further, the user terminal 600 is provided such that temperature adjustment information received from the outside through a network or temperature adjustment information input by a user is transmitted to the cooling unit 400 through the controller 500.

In this configuration, the cooling unit 400 is a Peltier element 420 of which the cooling level depends on the intensity of an applied current, the intensity of a current is changed by comparing the temperature information periodically collected in the controller 500 and preset temperature information with each other, the variation of the collected temperature information is calculated, and the intensity of a current is maintained, increased, or decreased, depending on the calculated variation, such that the cooling function is maintained or current energy efficiency for cooling is increased.

Meanwhile, in the cooling pad unit 300, the cooling inflow hole 330 and the cooling outflow hole 350 are disposed on the short side 310 in the direction facing the ground in which the cooling unit 400 is positioned, the cooling channels 340 are disposed in at least one or more rows in parallel with the long sides 320 in the direction perpendicular to the ground, and the curved contact surface 360 that comes in contact with the lining 200 or the skin of a wearer is formed thinly such that the height is ⅓ or ⅔ of the thickness facing the outer cover 100.

Further, it is preferable that the curved contact surface 360 has many cooling protrusions 361 formed toward the skin of a wearer and cooling spaces 362 formed between the cooling protrusions 361 and the cross-sections of the cooling protrusions 361 gradually decrease toward the skin of a wearer.

Preferred embodiments of the present disclosure were described above, but it would be understood by those skilled in the art that these embodiments described above are only examples of the spirit of the present disclosure and the present disclosure may be changed in various ways without departing from the spirit of the present disclosure. Accordingly, the protective range of the present disclosure should be construed by those described in claims rather than specific embodiments and all spirits within a corresponding range should also be construed as being included in the right range of the present disclosure.

What is claimed is:

1. An ICT technology-based piece of cooling clothing comprising:

an outer cover forming an external shape of the piece of cooling clothing and having a receiving pocket;

a lining provided to be disposed toward the skin of a wearer that is the inside of the outer cover;

a cooling pad unit disposed between the outer cover and the lining or inside the lining, made of a rectangular flexible material having short sides and long sides to transmit coolness to a wearer, and having a cooling inflow hole, cooling channels, and a cooling outflow hole;

a cooling unit supplying cool air by being connected to the cooling inflow hole of the cooling pad unit and absorbing heat, which is generated by the cooling pad unit, through the cooling outflow hole, thereby performing heat dissipation and cooling;

a controller provided to collect temperature information from at least any one of the cooling pad unit or the cooling unit through a temperature information collector and to transmit a cooling control signal to the cooling unit; and a user terminal connected with the controller through a network and provided to receive and display the temperature information on a display and to transmit a control signal of a user to the controller, wherein the cooling pad unit has a curved contact surface disposed to have an up-down length from the center of the back to the back of the neck of a wearer and protruding to be curved toward the wearer between the long sides to improve the feeling of close contact on the wearer; the controller is received in the receiving pocket to be able to be inserted and taken out, and the controller and the cooling unit are connected through a connector line; and the connector line can be separated from the controller and the cooling unit and is a flexible line.

2. The ICT technology-based piece of cooling clothing of claim 1, wherein the lining is formed in a type in which first threads having a first cross-section and second threads having a second cross-section, which are different cross-sections, are woven together to increase the feeling of coolness for a wearer.

3. The ICT technology-based piece of cooling clothing of claim 1, wherein the user terminal is provided such that temperature adjustment information received from the outside through a network or temperature adjustment information input by a user is transmitted to the cooling unit through the controller; and the cooling unit is a Peltier element of which a cooling level depends on the intensity of an applied current, the intensity of a current is changed by comparing the temperature information periodically collected in the controller and preset temperature information with each other, a variation of the collected temperature information is calculated, and the intensity of a current is increased or decreased, depending on the degree of the variation.

4. The ICT technology-based piece of cooling clothing of claim 1, wherein in the cooling pad unit, the cooling inflow hole and the cooling outflow hole are disposed on the short side in a direction facing the ground in which the cooling unit is positioned, the cooling channels are disposed in at least one or more rows in parallel with the long sides in a direction perpendicular to the ground, and the curved contact surface that comes in contact with the lining or the skin of a wearer is formed thinly such that a height thereof is ⅓ or ⅔ of a thickness facing the outer cover.

5. The ICT technology-based piece of cooling clothing of claim 4, wherein the curved contact surface has many cooling protrusions formed toward the skin of a wearer and cooling spaces formed between the cooling protrusions and cross-sections of the cooling protrusions gradually decrease toward the skin of a wearer.

* * * * *